US006080479A

United States Patent [19]

Sogabe et al.

[11] Patent Number: 6,080,479

[45] Date of Patent: Jun. 27, 2000

[54] THERMAL TRANSFER RECORDING MEDIUM

[75] Inventors: Jun Sogabe; Yuuichi Miyakusa, both of Osaka, Japan; Hitomi Kawabata, St. Lower Hutt, New Zealand

[73] Assignee: Fujicopian Co., Ltd., Osaka, Japan

[21] Appl. No.: 08/909,670

[22] Filed: Aug. 12, 1997

[51] Int. Cl.[7] ..... B41M 5/26

[52] U.S. Cl. ..... 428/344; 428/195; 428/209; 428/346; 428/354; 428/913; 428/914

[58] Field of Search ..... 428/195, 484, 428/488.1, 488.4, 913, 914, 209, 344, 354, 346

[56] References Cited

FOREIGN PATENT DOCUMENTS 0 263 478 A2 4/1988 European Pat. Off. ..... B41M 5/26

3056800 10/1992 Japan ..... B41M 5/10

*Primary Examiner*—Pamela R. Schwartz
*Attorney, Agent, or Firm*—Fish & Neave

[57] ABSTRACT

A thermal transfer recording medium providing clear printed images with a metallic luster without causing blocking is disclosed which comprises a foundation, and provided on one side of the foundation in order from the foundation side, at least a colored ink layer or a substantially colorless transparent layer with no coloring agent, a metal deposition layer and an adhesive layer, and a heat-resistant layer provided between the metal deposition layer and the adhesive layer and comprising as the main component a resin having a glass transition temperature of not lower than 65° C. and a melt viscosity of not higher than $1\times10^3$ cps at 160° C.

7 Claims, No Drawings

THERMAL TRANSFER RECORDING MEDIUM

BACKGROUND OF THE INVENTION

The present invention relates to a thermal transfer recording medium for forming printed images with a metallic luster.

Conventional thermal transfer recording media of this type include one with a structure comprising a foundation having on one side thereof a colored or uncolored ink layer, a metal deposition layer and an adhesive layer in this order.

Thermal transfer recording media having such a structure do not necessarily have a high transfer sensitivity and, hence, the recording media are not suited for a high speed printing or a low energy printing.

The lowering of the softening temperature of the adhesive layer has been proposed to increase the transfer sensitivity. However, the lowering of the softening temperature of the adhesive layer invites another problem that the recording medium, which is wound in a roll form, causes blocking when it is stored at high temperatures.

Accordingly, it has been difficult to increase the transfer sensitivity of the thermal transfer recording media of this type.

In view of the foregoing, it is an object of the present invention to provide a thermal transfer recording medium comprising a foundation having on one side thereof a colored ink layer or a substantially colorless transparent layer with no coloring agent, a metal deposition layer and an adhesive layer in this order which does not cause blocking even when the softening temperature of the adhesive layer is lowered to increase the transfer sensitivity.

This and other objects of the present invention will become apparent from the description hereinafter.

SUMMARY OF THE INVENTION

The present invention provides a thermal transfer recording medium comprising a foundation, and provided on one side of the foundation in order from the foundation side, at least a colored ink layer or a substantially colorless transparent layer with no coloring agent, a metal deposition layer and an adhesive layer, and a heat-resistant layer provided between the metal deposition layer and the adhesive layer and comprising as the main component a resin having a glass transition temperature of not lower than 65° C. and a melt viscosity of not higher than $1\times10^3$ cps at 160° C.

According to an embodiment of the present invention, the adhesive layer has a softening temparature of from 50° to 70° C.

According to another embodiment of the present invention, the heat-resistant layer comprises not less than 80% by weight of the resin having a glass transition temparature of not lower than 65° C. and a melt viscosity of not higher than $1\times10^3$ cps at 160° C.

According to yet another embodiment of the present invention, the resin having a glass transition temperature of not lower than 65° C. and a melt viscosity of not higher than $1\times10^3$ cps at 160° C. comprises at least a resin selected from the group consisting of styrene resins, terpene resins, phenol resins, rosin resins and aromatic petroleum resins.

According to a further embodiment of the present invention, the adhesive layer comprises an adhesive resin and a particulate inorganic material.

According to yet another embodiment of the present invention, the thermal transfer recording medium further comprises a release layer provided between the foundation and the colored or substantially colorless ink layer.

According to a further embodiment of the present invention, the thermal transfer recording medium further comprises a layer for protecting the metal deposition layer provided between the colored or substantially colorless ink layer and the metal deposition layer.

DETAILED DESCRIPTION

The present invention relates to an improvement of a thermal transfer recording medium comprising a foundation having on one side thereof a colored or substantially colorless ink layer, a metal deposition layer and an adhesive layer. According to the present invention, it has been found out that the provision of a layer (hereinafter referred to as "heat-resistant layer") composed of as a main component a resin having a high glass transition temperature and a low melt viscosity between the metal deposition layer and the adhesive layer in the thermal transfer recording medium of the aforesaid structure, prevents blocking during storage at high temperatures even when the softening temperature of the adhesive layer is set to a low temperature range of 50° to 70° C. The reason therefor remains undetermined.

Accordingly, it is possible to adopt a softening temperature of 50° to 70° C. for the adhesive layer for increasing the transfer sensitivity, thereby resulting in a high speed printing or a low energy printing.

The present invention will be explained in detail.

The thermal transfer recording medium of the present invention has a basic structure comprising a foundation and provided on one side of the foundation in order from the foundation side, a colored ink layer or a substantially colorless transparent layer with no coloring agent, a metal deposition layer, a heat-resistant layer and an adhesive layer.

As required, a release layer may be provided between the foundation and the colored or substantially colorless ink layer, and/or, a layer for protecting the metal deposition layer (or an anchor layer for the metal deposition layer) may be provided between the colored or substantially colorless ink layer and the metal deposition layer.

As the foundation, one can use any films or sheets generally used as a foundation for thermal transfer recording media, inclusive of plastic films such as polyester films, polyamide films and polycarbonate films, and thin paper sheets such as a condenser paper. The foundation preferably has a thickness of about 1 to about 10 $\mu$m. As required, a heat-resistant protective layer may be provided on the backside (the side to be contacted by a thermal head) of the foundation in order to prevent the thermal head from sticking to the foundation.

The release layer to be optionally provided functions as follows: When being transferred, the release layer is melted by means of heat signals from the thermal head to facilitate the release of portions of a transfer layer heated, wherein the transfer layer is composed of the stacked ink layer/metal deposition layer/heat-resistant layer/adhesive layer, or the stacked ink layer/anchor layer/metal deposition layer/heat-resistant layer/adhesive layer. The release layer is composed of a wax as a main component. As required, the release layer may be incorporated with a thermoplastic resin (inclusive of elastomer) to adjust the adhesion between the release layer and the foundation or the ink layer.

Examples of the aforesaid wax include natural waxes such as haze wax, bees wax, lanolin, carnauba wax, candelilla wax, montan wax and ceresine wax; petroleum waxes such as paraffin wax and microcrystalline wax; synthetic waxes such as oxidized wax, ester wax, low-molecular-weight polyethylene wax, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes may be used either alone or in combination.

Examples of the aforesaid thermoplastic resin include polyester resins, polyamide resins, polyurethane resins, ethylene-vinyl acetate copolymers, vinyl chloride-vinyl acetate copolymers, vinyl chloride-vinyl acetate-maleic acid terpolymers, polyvinyl butyrals, α-olefin-maleic anhydride copolymers, ethylene-(meth)acrylic acid ester copolymers, low-molecular-weight styrene resins, ethylene-styrene copolymers, styrene-butadiene copolymers, petroleum resins, rosin resins, terpene resins, polypropylene resins and ionomer resins. These resins may be used either alone or in combination.

The release layer can be formed by applying onto the foundation a coating liquid, which is prepared by dissolving or dispersing the wax and optionally the thermoplastic resin into a suitable solvent (inclusive of water), followed by drying. Alternatively, the release layer can be formed by a hot-melt coating method. The coating amount (on a dry weight basis, hereinafter the same) of the release layer is usually from about 0.2 to about 3 $g/m^2$.

Usually the ink layer is used to provide a metallic luster in a variety of colors which are not limited to the metallic luster inherent to the metal deposition layer used and, hence, the ink layer is a colored ink layer composed of a binder and a coloring agent as the main components. However, when a metallic luster inherent to the metal deposition layer used is required as it is, a substantially colorless transparent ink layer incorporated with no coloring agent may be used.

The binder for the ink layer is composed of a thermoplastic resin and/or a wax.

Examples of the aforesaid thermoplastic resin include polyester resins, polyamide resins, polyurethane resins, ethylene-vinyl acetate copolymers, vinyl chloride-vinyl acetate copolymers, ethylene-(meth)acrylic acid ester copolymers, polypropylene resins, petroleum resins, rosin resins and terpene resins. These resins may be used either alone or in combination.

Examples of the aforesaid wax include natural waxes such as haze wax, bees wax, lanolin, carnauba wax, candelilla wax, montan wax and ceresine wax; petroleum waxes such as paraffin wax and microcrystalline wax; synthetic waxes such as oxidized wax, ester wax, low-molecular-weight polyethylene wax, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes may be used either alone or in combination.

Useful as the coloring agent are any organic and inorganic pigments. A dye may be used in combination with the pigment for color adjustment. The content of the coloring agent in the colored ink layer is usually from about 5 to about 40% by weight.

As the pigment one uses yellow pigments, magenta pigments and cyan pigments, and mixtures of one or more species thereof. Preferably these pigments are transparent.

Examples of yellow pigments include Disazo Yellow HR, Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake. These yellow pigments may be used either alone or in combination.

Examples of magenta pigments include Quinacridone Red, Parmanent Carmine F5B, Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y and Arizalin Lake. These magenta pigments may be used either alone or in combination.

Examples of cyan pigments include Victoria Blue Lake, metal-free Phthalocyanine Blue, Phthalocyanine Blue and Fast Sky Blue. These cyan pigments may be used either alone or in combination.

The ink layer can be formed by applying onto the foundation or release layer a coating liquid, which is prepared by dissolving or dispersing the aforesaid binder into a suitable solvent (inclusive of water) and optionally dispersing thereinto a coloring agent, followed by drying. Alternatively, the ink layer can be formed by a hot-melt coating method. The coating amount of the ink layer is usually from about 0.2 to about 3 $g/m^2$.

The layer for protecting the metal deposition layer to be optionally provided serves as an anchor layer for the metal deposition layer. The anchor layer is composed predominantly of a thermoplastic resin (inclusive of elastomer). Usually the anchor layer is not colored and, hence, is a substantially colorless transparent layer.

Examples of the aforesaid thermoplastic resin include polyester resins, polyamide resins, polyurethane resins, ethylene-vinyl acetate copolymers, vinyl chloride-vinyl acetate copolymers, ethylene-(meth)acrylic acid ester copolymers, (meth)acrylic resins, styrene-butadiene copolymers, petroleum resins, polypropylene resins and ionomer resins. These resins may be used either alone or in combination.

The anchor layer can be formed by applying onto the ink layer a coating liquid, which is prepared by dissolving or dispersing the aforesaid resin into a suitable solvent (inclusive of water), followed by drying. A small coating amount is suitable for the anchor layer from the viewpoint of transferability so long as the protective function is secured. A suitable coating amount is from about 0.1 to about 1 $g/m^2$.

Examples of metals for the metal deposition layer are aluminum, zinc, tin, nickel, chromium, titanium, copper, silver, gold, platinum, and the like metals, and mixtures or alloys thereof. Usually aluminum is preferred. The metal deposition layer can be formed by a physical deposition technique such as vacuum deposition, sputtering or iron plating, or chemical deposition technique.

To obtain a high metallic luster, the thickness of the metal deposition layer is preferably in the range of 10 to 100 nm, especially 20 to 40 nm.

The heat-resistant layer is composed of a resin having a glass transition temperature of not lower than 65° C. and a melt viscosity of not higher than $1\times10^3$ cps at 160° C. Preferably the heat-resistant layer contains not less than 80% by weight of such a specific resin.

When using the heat-resistant layer, composed of the specific resin as the main component, between the metal deposition layer and the adhesive layer, the thermal transfer recording medium is prevented from blocking even if the adhesive layer has a low softening temperature in the range of 50° to 70° C.

When the glass transition temperature of the specific resin is lower than 65° C., the blocking preventive effect is not sufficiently exhibited. When the melt viscosity of the specific resin is higher than $1\times10^3$ cps at 160° C., the transfer sensitivity is lowered. The upper limit for the glass transition temperature of the specific resin is about 100° C. to achieve acceptable transfer sensitivity.

Examples of the specific resins include styrene resins, terpene resins, phenol resins, rosin resins and aromatic petroleum resins. These resins may be used either alone or in combination.

As required, the heat-resistant layer may be further incorporated with an additive such as an elastomer or a wax.

Preferably the heat-resistant layer contains substantially no particulate materials such as coloring pigment and body pigment and, hence, is colorlessly transparent. This is to prevent the lowering of the luster of printed images due to the unevenness of the surface of the heat-resistant layer caused by the particulate material.

Preferably the coating amount of the heat-resistant layer is not less than 0.2 g/m$^2$ to prevent blocking and not more than 1 g/m$^2$ to achieve acceptable transferability.

The heat-resistant layer can be formed by applying onto the metal deposition layer a coating liquid, which is prepared by dissolving or dispersing the aforesaid specific resin and optionally other additives into a suitable solvent (inclusive of water), followed by drying.

The adhesive layer is composed of predominantly an adhesive resin. Examples of the adhesive resin are polyester resins, polyamide resins, polyurethane resins, ethylene-vinyl acetate copolymers, ethylene-(meth)acrylic acid ester copolymers, petroleum resins, rosin resins and terpene resins. These adhesive resins may be used either alone or in combination.

The softening temperature of the adhesive layer is preferably in the range of 50° to 70° C. to achieve acceptable transfer sensitivity.

Preferably the adhesive layer is incorporated with a particulate material to more sufficiently prevent blocking or to prevent the smudging of a receptor paper.

Examples of the particulate material are silica, talc, calcium carbonate, precipitated barium sulfate, alumina, clay, magnesium carbonate, carbon black, tin oxide, titanium oxide, and the like. These materials may be used either alone or in combination. Preferably the particle size of the particulate material is in the range of 0.1 to 1 $\mu$m in terms of average particle size. It is preferable that the content of the particulate material in the adhesive layer is not less than 5% by weight to sufficiently prevent blocking and smudging and not more than 50% by weight to achieve acceptable adhesiveness.

The adhesive layer can be formed by applying onto the heat-resistant layer a coating liquid, which is prepared by dissolving or dispersing the aforesaid adhesive resin into a suitable solvent (inclusive of water) and optionally dispersing thereinto the particulate material, followed by drying. The coating amount of the adhesive layer is preferably in the range of about 0.2 to about 1.5 g/m$^2$.

The present invention will be described in more detail by way of Examples and Comparative Examples. It is to be understood that the present invention will not be limited to these Examples, and various changes and modifications may be made in the invention without departing from the spirit and scope thereof.

EXAMPLES 1–2 and COMPARATIVE EXAMPLES 1–3

Onto the front side of a 3.5 $\mu$m —thick polyethylene terephthalate film having a heat-resistant protective layer composed of a silicone resin on the back side thereof was applied a composition for a release layer of the following formula by a hot-melt coating method to give a relase layer with a coating amount of 1.0 g/m$^2$.

Composition for release layer

| Component | Parts by weight |
|---|---|
| Paraffin wax | 60 |
| Candelilla wax | 40 |
| Total | 100 |

Onto the release layer was applied a coating liquid for a colored ink layer of the following formula, followed by drying to give a colored ink layer with a coating amount of 1.0 g/m$^2$.

Coating liquid for colored ink layer

| Component | Parts by weight |
|---|---|
| Polyamide resin | 6.0 |
| Polyethylene wax | 2.0 |
| Brilliant Carmine 6B | 2.0 |
| Dispersing agent | 0.1 |
| Toluene | 9.9 |
| Isopropyl alcohol | 80.0 |
| Total | 100.0 |

Onto the colored ink layer was applied a coating liquid for an anchor layer of the following formula, followed by drying to give an anchor layer with a coating amount of 0.5 g/m$^2$.

Coating liquid for anchor layer

| Component | Parts by weight |
|---|---|
| Acrylic resin (glass transition temp.: 90° C.) | 10 |
| Methyl ethyl ketone | 90 |
| Total | 100 |

Onto the anchor layer was formed an aluminum deposition layer having a thickness of 20 nm by a vacuum deposition method. Onto the aluminum deposition layer was applied a coating liquid for a heat-resistant layer of the formula shown in Table 1, followed by drying to give a heat-resistant layer with a coating amount of 0.5 g/m$^2$. In Comparative Example 1, no heat-resistant layer was formed.

Onto the heat-resistant layer was applied a coating liquid for an adhesive layer of the following formula, followed by drying to give an adhesive layer with a coating amount of 0.5 g/m$^2$.

| Coating liquid for adhesive layer | |
|---|---|
| Component | Parts by weight |
| Ethylene-vinyl acetate copolymer (softening point: 55° C.) | 8.0 |
| Silica particles (average particle size: 0.5 μm) | 2.0 |
| Dispersing agent | 0.1 |
| Toluene | 89.9 |
| Total | 100.0 |

Each of the thus obtained thermal transfer recording media was evaluated for transferability and antiblocking properties. The results are shown in Table 1.

A. Transferability Property

Two-dot vertical lines were printed on a receptor paper (Xerox #4024 made by Xerox Inc.) by means of a thermal transfer printer (Bungo Mini 5 made by NEC Corporation) wherein each of the recording media was used. The term "two-dot vertical lines" means vertical lines each having two-dot width arranged at two-dot intervals in the lateral direction. The transferability was evaluated on the basis of the following criteria.

O . . . Vertical lines were printed with a space.

X . . . Vertical lines were joined together.

B. Antiblocking Property

Each thermal transfer recording medium was wound in a roll form and stored in an enviornment of 50° C. and 85% RH for 96 hours. Using the stored recording medium, printing was performed under the same conditions as above. The antiblocking property was evaluated on the basis of the following criteria:

O . . . The ribbon was smoothly unwound and dispensed and could be used up to the end thereof for printing.

X . . . It was impossible to unwind the ribbon midway, resulting in failure to print.

TABLE 1

| Coating liquid for heat-resistant layer | Ex. 1 | Ex. 2 | Com. Ex. 1 | Com. Ex. 2 | Com. Ex. 3 |
|---|---|---|---|---|---|
| Formula (% by weight) | | | | | |
| Polystyrene (Tg: 50° C., viscosity: 12 cps/160° C.) | — | — | — | 10 | — |
| Polystyrene (Tg: 70° C., viscosity: 7 cps/160° C.) | 10 | — | — | — | — |
| Aromatic petroleum resin (Tg: 95° C., viscosity: 580 cps/160° C.) | — | 10 | — | — | — |
| Acrylic resin (Tg: 90° C., viscosity: 2500 cps/160° C.) | — | — | — | — | 10 |
| Toluene | 90 | 90 | — | 90 | — |
| Methyl ethyl ketone | — | — | — | — | 90 |

TABLE 1-continued

| Coating liquid for heat-resistant layer | Ex. 1 | Ex. 2 | Com. Ex. 1 | Com. Ex. 2 | Com. Ex. 3 |
|---|---|---|---|---|---|
| Evaluation | | | | | |
| Transferability | ○ | ○ | ○ | ○ | × |
| Antiblocking property | ○ | ○ | × | × | ○ |

Tg: Glass transition temperature

According to the present invention, a thermal transfer recording medium comprising a foundation having on one side thereof a substantially colorless or uncolored ink layer, a metal deposition layer and an adhesive layer in this order wherein a specific heat-resistant layer is provided between the metal deposition layer and the adhesive layer does not cause blocking even when the softening temperature of the adhesive layer is lowered to improve transferability.

What we claim is:

1. A thermal transfer recording medium comprising a foundation, and provided on one side of the foundation in order from the foundation side, at least a colored ink layer or a substantially colorless transparent layer with no coloring agent, a metal deposition layer and an adhesive layer, and a heat-resistant layer provided between the metal deposition layer and the adhesive layer and comprising as the main component by weight a resin having a glass transition temperature of not lower than 65° C. and a melt viscosity of not higher than $1\times10^3$ cps at 160° C.

2. The thermal transfer recording medium of claim 1, wherein the adhesive layer has a softening temperature of from 50° to 70° C.

3. The thermal transfer recording medium of claim 1, wherein the heat-resistant layer comprises not less than 80% by weight of the resin having a glass transition temperature of not lower than 65° C. and a melt viscosity of not higher than $1\times10^3$ cps at 160° C.

4. The thermal transfer recording medium of claim 1, wherein the resin having a glass transition temperature of not lower than 65° C. and a melt viscosity of not higher than 1×103 cps at 160° C. comprises at least a resin selected from the group consisting of styrene resins, terpene resins, phenol resins, rosin resins and aromatic petroleum resins.

5. The thermal transfer recording medium of claim 1, wherein the adhesive layer comprises an adhesive resin and a particulate inorganic material.

6. The thermal transfer recording medium of claim 1, which further comprises a release layer provided between the foundation and the colored ink layer or the substantially colorless transparent layer with no coloring agent.

7. The thermal transfer recording medium of claim 1, which further comprises a layer for protecting the metal deposition layer provided between the colored ink layer or the substantially colorless transparent layer with no coloring agent and the metal deposition layer.

* * * * *